US009613762B2

(12) United States Patent
Nukaga et al.

(10) Patent No.: US 9,613,762 B2
(45) Date of Patent: Apr. 4, 2017

(54) POWER SWITCHGEAR

(71) Applicant: Hitachi, Ltd., Chiyoda-ku, Tokyo (JP)

(72) Inventors: Jun Nukaga, Tokyo (JP); Yoshio Hamadate, Tokyo (JP); Tomohiro Moriyama, Tokyo (JP); Yoshiaki Seya, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 14/813,723

(22) Filed: Jul. 30, 2015

(65) Prior Publication Data

US 2016/0035501 A1 Feb. 4, 2016

(30) Foreign Application Priority Data

Aug. 1, 2014 (JP) ..... 2014-157299

(51) Int. Cl.

| | |
|---|---|
| ***H01H 1/38*** | (2006.01) |
| ***H01H 1/60*** | (2006.01) |
| ***H01H 3/62*** | (2006.01) |
| ***H01H 1/40*** | (2006.01) |

(52) U.S. Cl.

CPC ..... *H01H 1/385* (2013.01); *H01H 1/60* (2013.01); *H01H 3/62* (2013.01); *H01H 2001/406* (2013.01)

(58) Field of Classification Search

CPC H01H 1/385; H01H 1/36; H01H 1/66; H01H 1/60; H01H 3/62; H01H 33/64; H02B 13/02

USPC .. 218/154, 7, 12, 14, 16, 55, 57, 67, 69, 75, 218/78, 79, 80

See application file for complete search history.

(56) References Cited

U.S. PATENT DOCUMENTS

| | | | | |
|---|---|---|---|---|
| 5,045,652 | A * | 9/1991 | Yanabu | H01H 33/24 218/116 |
| 6,681,682 | B2 * | 1/2004 | Niwa | F15B 15/1433 92/153 |
| 6,946,613 | B2 * | 9/2005 | Otsuka | H01H 31/32 218/79 |
| 7,479,612 | B2 * | 1/2009 | Waldi | H01H 3/264 200/507 |
| 8,106,326 | B2 * | 1/2012 | Nakauchi | H01H 31/003 218/55 |
| 2007/0075046 | A1 * | 4/2007 | Nakamura | C10M 169/00 218/123 |

FOREIGN PATENT DOCUMENTS

| | | |
|---|---|---|
| EP | 2 525 455 A1 | 11/2012 |
| JP | 2011-147217 A | 7/2011 |

* cited by examiner

*Primary Examiner* — Renee S Luebke
*Assistant Examiner* — William Bolton
(74) *Attorney, Agent, or Firm* — Crowell & Moring LLP

(57) ABSTRACT

Disclosed is a power switch gear that includes: a fixed electrode and a movable electrode disposed opposite to each other in a tank filled with insulting gas; and a movable conductor electrically connecting the fixed electrode and the movable electrode together. The fixed electrode and the movable electrode have a contactor through which current flows to the movable conductor. At least one of the fixed electrode and the movable electrode has ring-shaped sliding members, the ring-shaped sliding members being disposed, on both sides of the contactor. At least one grease pool is provided between the contactor and the sliding members.

2 Claims, 6 Drawing Sheets

POWER SWITCHGEAR

BACKGROUND OF THE INVENTION

1. Field of the Invention

The present invention relates to a power switchgear and particularly to electrodes configurations for the switchgear.

2. Description of the Related Art

A gas insulated switchgear includes a power switchgear, such as a breaker, a disconnector, and an earthing switch, and a bus bar. The breaker interrupts fault current, the disconnector energizes/de-energizes an electrical circuit, and the earthing switch connects a device to the ground. The bus bar, having a high-voltage conductor in its inside, extends to a transformer. A failed gas insulated switchgear could lead to a problem, such as blackout, with an energy transmission and transformation system. Thus, gas insulated switchgears of high reliability are being called for.

The gas insulated switchgear has the switchgears of various types as described above, the switchgears being provided with a great number of sliding portions at their mechanism portions and contact parts. The bus bars are separated via a sliding portion. At a time of absorbing a displaced portion resulting from heat shrinkage or an earthquake, the sliding portion absorbs the displaced portion. Such a sliding portion is required to have sliding characteristics such as small frictional force and little abrasion amount and be able to prevent gradation and reduction of a lubricant and diffusion of a degradable living substance between electrodes of a disconnector.

To maintain for a long period of time such a condition that a sliding portion has a small frictional force and a low depth of wear, the conventional gas insulated, switchgear disclosed in JP-2011-147217-A is configured as follows. A movable contactor has a hard, carbon film on its circumferential surface except following two areas: one that is in contact with a contact, terminal of a stationary-side contact part, while a movable-side contact part is inserted into the stationary-side contact part to be electrically connected; and another that is in contact with a contact terminal of the movable-side contact part while the movable-side contact part and the stationary-side contact part are electrically disconnected.

SUMMARY OF THE INVENTION

The conventional gas insulated switchgear described above has following problems. During its sliding, the hard film portion comes into contact with the electric contact point to generate heat caused by the resistance of the hard film. This heat could contribute to possible damage to the hard film portion. In the event that the scratched film by the sliding scatters around as foreign matters, the switchgear is likely to have reduced insulation performance. Because of long-term use of the apparatus, the grease or lubricant of the sliding portion may be scattered or deteriorated. The insulation performance between electrodes consequently declines or the fractional force of the sliding portion increases as a result.

The present invention has been made to solve the above problems and aims to provide a power switchgear that can maintain a condition that a frictional force at a sliding portion is small and prevent the scattering of lubricants.

According to one aspect of the present invention, there is provided a power switchgear including: a fixed electrode and a movable electrode disposed opposite to each other in a tank filled with insulting gas; and a movable conductor electrically connecting the fixed electrode and the movable electrode together. The fixed electrode and the movable electrode each have a contactor through which current flows to the movable conductor. At least one of the fixed, electrode and the movable electrode has ring-shaped sliding members, the ring-shaped sliding members being disposed on both sides of the contactor. At least one grease pool is provided between the contactor and the sliding members.

The switchgear of the present invention is capable of eliminating partial contact in the sliding portion between the movable conductor and the contactor to stably reduce the contact resistance therebetween. Plus, foreign matters produced due to the sliding between the movable conductor and the contact will not be thrown out in an apparatus. The switchgear is further capable of preventing declining insulation performance.

BRIEF DESCRIPTION OF THE DRAWINGS

Other objects and advantages of the invention will become apparent from the following description of embodiments with reference to the accompanying drawings in which.

DESCRIPTION OF THE PREFERRED EMBODIMENTS

Preferred embodiments of the present invention will hereinafter be described with reference to the drawings. The following describes embodiments but does not intend to limit the contents of the invention to the specific aspect as below. The invention itself can be modified into various aspects in a range fulfilling the description of claims.

First Embodiment

Figure 1:
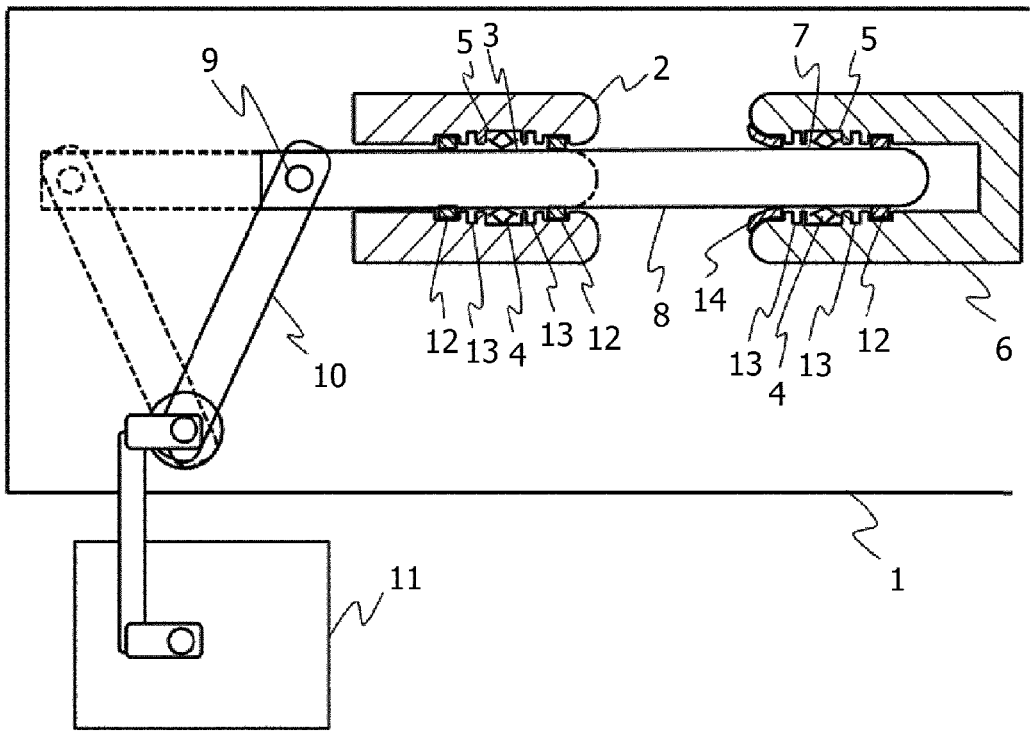
FIG. 1 is a cross-sectional view of a power switchgear according to a first embodiment.

FIG. 1 is a cross-sectional view of a switchgear according to a first embodiment of the present invention. An insulation gas such as SF6 is filled in a tank 1 in which the switchgear is installed. On a movable side of the switchgear a movable contact part 3 is located in a movable electrode 2. A leaf-spring-shaped contactor 4 is used as a contactor of the movable electrode 2. The leaf-spring-shaped contactor 4 is secured to a groove 5 provided in the movable contact part 3.

A fixed electrode 6 is disposed at a position opposite to the movable electrode 2. On a stationary side of the switchgear a fixed contact part 7 is located inside the fixed electrode 6 in a closed state. A leaf-spring-shaped contactor 4 is used as a contactor of the fixed electrode 6.

A movable conductor 8 is inserted into the movable electrode 2. Preferably, the movable electrode 2 and the fixed electrode 6 are provided coaxially with a central axis extending along the moving direction of the movable conductor 8. The movable conductor 8 electrically connects and disconnects the movable electrode 2 to and from the fixed electrode 6.

A pin 9 serving as a connecting member is provided at one end of the movable conductor 8. The pin 9 is connected to one end of a lever member 10 in a slidable state. The lever member 10 receives at the other end via a link mechanism the driving force produced by an operating mechanism 11 located outside the tank 1 of the switchgear to move the movable conductor 8. This movement allows electrical connection and disconnection with the fixed electrode 6.

Figure 2:
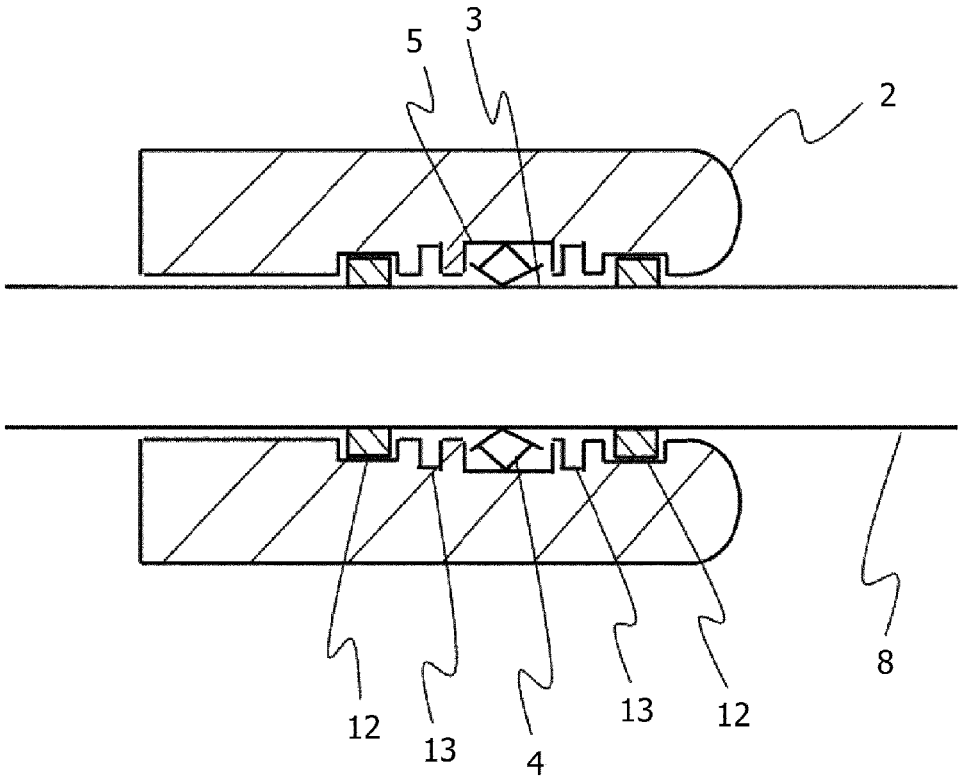
FIG. 2 is a cross-sectional view of a movable contact part according to the first embodiment.

FIG. 2 is a cross-sectional view of the movable contact part 3. Ring-shaped sliding elements 12 are disposed on both sides of the leaf-spring-shaped contactor 4 provided in the movable electrode 2. The sliding elements 12 are fixedly fitted into respective grooves provided in the movable electrode 2. The height and inside diameter of the sliding element 12 are set so that a contact position between the leaf-spring-shaped contactor 4 and the movable conductor 8 are within an allowable range of deformation amount of the contactor 4 during the contact therebetween. Consequently, the movable conductor 8 is constantly held for sliding by use of the sliding elements 12 at a position in the allowable range of deformation amount of the leaf-spring-shaped contactor 4. Thus, the movable conductor 8 can come into constant contact with the leaf-spring-shaped contactor 4, thereby providing a stable contact resistance value.

In the movable electrode 2 a groove is provided as a grease pool 13 between a position at which the leaf-spring-shaped contactor 4 is disposed and another position at which the sliding element 12 is provided. Foreign matters may be produced due to the sliding friction between the leaf-spring-shaped contactor 4 and the movable conductor 8. The foreign matters thus produced are made to stay in the grease pools 13 by the sliding elements 12 arranged in front and rear of the leaf-spring-shaped contactor 4. Thus, it is possible to prevent the foreign matters from scattering from the electrode to external space. In an area between the sliding elements 12 provided on both sides of the leaf-spring-shaped contactor 4, the grease pools 13 inhibit the grease from, running off of the sliding elements 12 because of the displacement of the grease caused by the sliding of the movable conductor 8.

Figure 3:
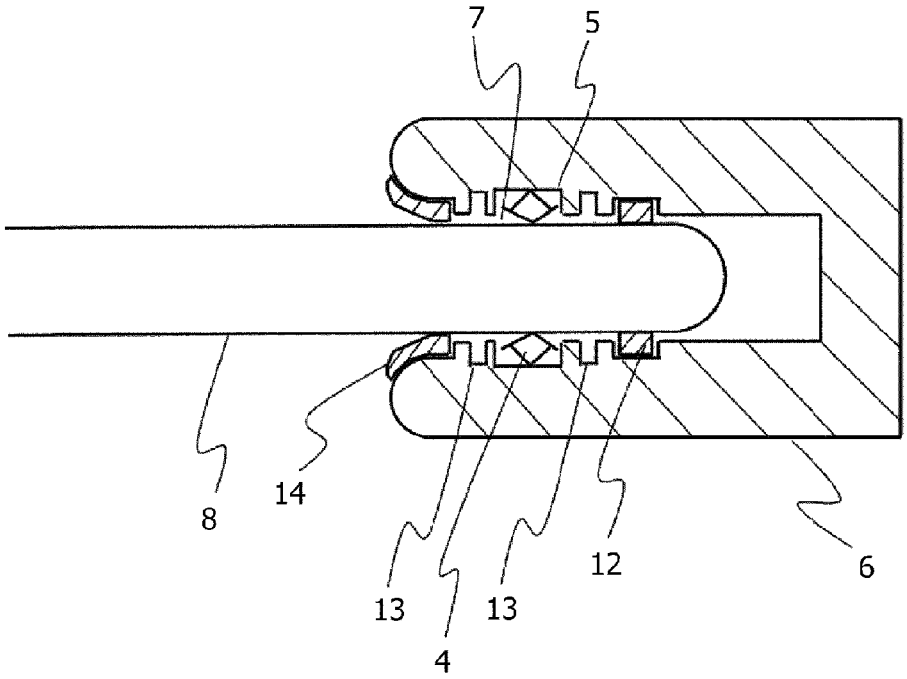
FIG. 3 is a cross-sectional view of a fixed electrode according to the first embodiment.

FIG. 3 is a cross-sectional view of the fixed electrode 6. A tapered sliding element 14 is installed at an opening for inserting the movable conductor on the side of the fixed electrode 6. In the event that the movement of the movable conductor 8 deviates from a straight, axis direction due to the link mechanism, the tapered sliding element 14 still can introduce the movable conductor 8 to a predetermined position with respect to the contactor 4 in the fixed electrode 6. The movable conductor 8 inserted into the fixed electrode 6 is such that the contact position between the leaf-spring-shaped contactor 4 and the movable conductor 8 can be brought in the allowable range of deformation amount, of the contactor 4 during the contact therebetween by use of the sliding element 12 and the tapered sliding element 14 which are provided on both sides of the leaf-spring-shaped contactor 4 in the fixed electrode 6. The height and inside diameter of the sliding element 12 are set so that the contact position between the leaf-spring-shaped contactor 4 and the movable conductor 8 may be in an allowable range of deformation amount of the contactor 4 during the contact therebetween. Consequently, the sliding element 12 constantly holds the movable conductor 8 for sliding at a position in the allowable range of deformation amount of the leaf-spring-shaped contactor 4 by. Thus, the movable conductor 8 can be brought into constant contact with the contactor 4, thereby providing a stable contact resistance value.

In the fixed electrode 6 a groove is provided as a grease pool 13 between a position at which the leaf-spring-shaped contactor 4 is disposed and another position at which the sliding element 12 is provided, and between a position at which the tapered sliding element 14 is disposed and the position at which the leaf-spring-shaped contactor 4 is provided. Foreign matters may be produced due to sliding friction between the leaf-spring-shaped contactor 4 and the movable conductor 8. The sliding element 12 and the tapered sliding element 14 prevent the thus produced foreign matters from scattering from the electrode to the external space. The grease pools 13 inhibit the grease from running off of the sliding element 12 and the tapered sliding element 14 because of the displacement of the grease caused by the sliding of the movable conductor 8.

Figure 4:
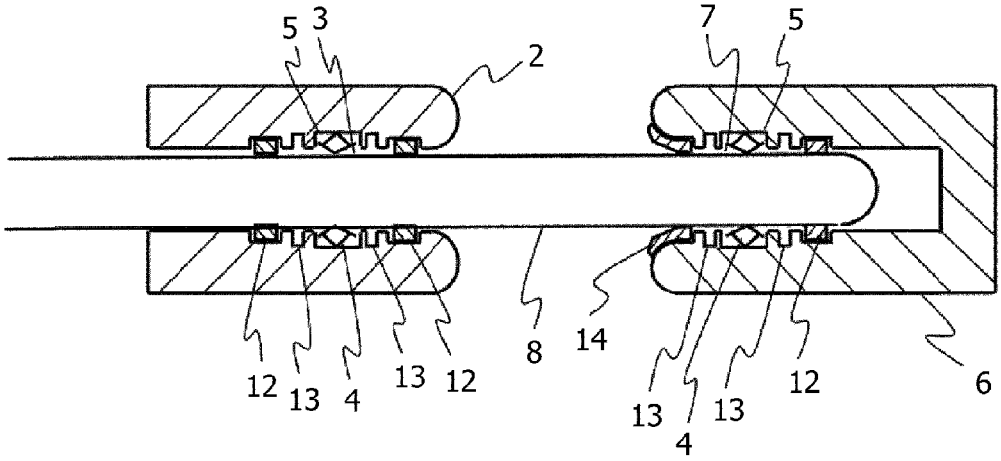
FIG. 4 illustrates the movable electrode and the fixed electrode according to the first embodiment being electrically connected.

With the above configuration, the movable conductor 8 is inserted into the fixed electrode 6 and the movable electrode 2 and the fixed electrode 6 are electronically connected as illustrated in FIG. 4. Although in such a condition, the movable conductor 8 and the movable-side contactor 4, and the movable conductor 8 and the fixed-side contactor 4 slide in the allowable range of deformation amount of the contact. The partial contact between the movable conductor 8 and the contactor 4 in the sliding portion is then eliminated. As a result, the contact resistance between the movable conductor 8 and the contactor 4 can be reduced in a stable manner. Further, the sliding elements 12 are arranged in front and rear of the contactor 4; therefore, foreign matters produced due to the sliding of the movable conductor 8 and the sliding element 4 can be prevented from scattering to the outside of the electrode.

Second Embodiment

Figure 5:
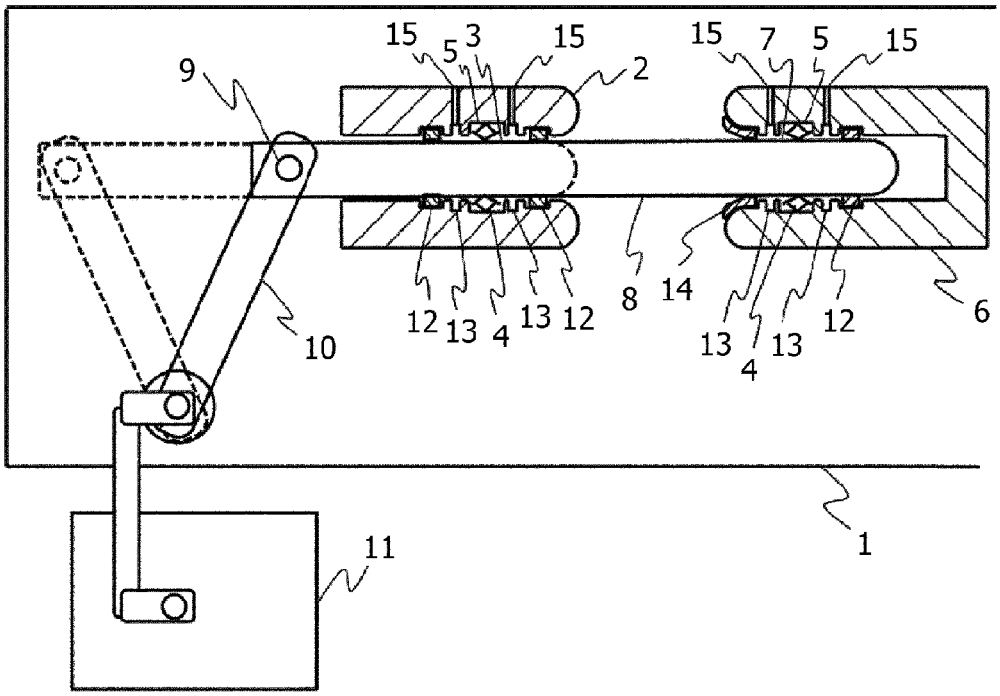
FIG. 5 is a cross-sectional view of a power switchgear according to a second embodiment.

FIG. 5 is a cross-sectional view of a switchgear according to a second embodiment of the present invention. An insulation gas such as SF6 is filled in a tank 1 in which the switchgear is installed. On a movable side of the switchgear a movable contact part 3 is located in a movable electrode 2. A leaf-spring-shaped, contactor 4 is used as a contactor of the movable electrode 2. The leaf-spring-shaped contactor 4 is secured to a groove 5 provided in the movable contact part 3.

A fixed electrode 6 is disposed at a position opposite to the movable electrode 2. On a stationary side of the switchgear a fixed contact part 7 is located inside the fixed electrode 6 in a closed state. A leaf-spring-shaped contactor 4 is used as a contactor of the fixed electrode 6.

A movable conductor 8 is inserted into the movable electrode 2. Preferably, the movable electrode 2 and the fixed electrode 6 are provided coaxially with a central axis extending along the moving direction of the movable conductor 8. The movable conductor 8 electrically connects and disconnects the movable electrode 2 to and from the fixed electrode 6.

A pin 9 serving as a connecting member is provided at one end of the movable conductor 8. The pin 9 is connected to one end of a lever member 10 in a slidable state. The lever member 10 receives at the other end the driving force produced by an operating mechanism 11 located outside the tank 1 of the switchgear so as to move the movable conductor 8. This movement allows electrical connection to and disconnection from the fixed electrode 6.

Figure 6:
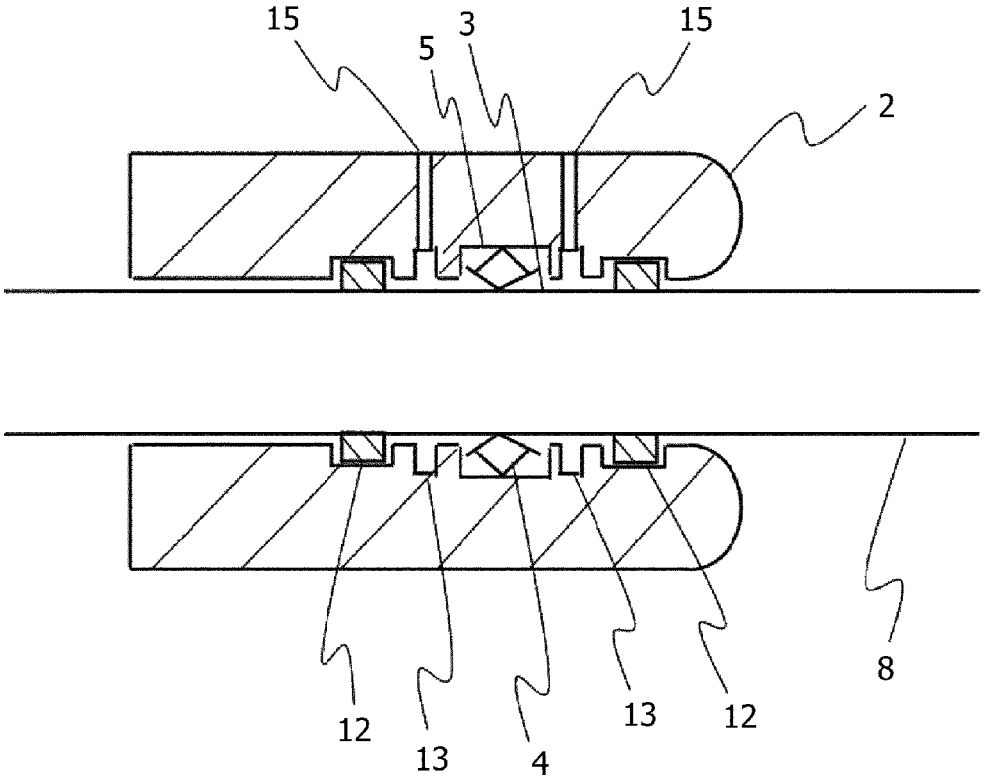
FIG. 6 is a cross-sectional view of a movable contact part according to the second embodiment.

FIG. 6 is a cross-sectional view of the movable contact part 3. Sliding elements 12 are on both sides of the leaf-spring-shaped contactor 4 provided in the movable electrode 2. The sliding elements 12 are secured to respective grooves provided in the movable electrode 2. The height and inside diameter of the sliding element 12 are set so that a contact position between the leaf-spring-shaped contactor 4 and the movable conductor 8 is within an allowable range of deformation amount of the contactor 4 during the contact therebetween. Consequently, the sliding elements 12 constantly holds the movable conductor 8 for sliding at a position in the allowable range of deformation amount of the leaf-spring-shaped contactor 4. Thus, the movable conductor 8 can come into constant contact with the leaf-spring-shaped contactor 4, thereby providing a stable contact resistance value.

In the movable electrode 2 a groove is provided as a grease pool 13 between a position at which the leaf-spring-shaped contactor 4 is disposed and another position at which the sliding element 12 is provided. Foreign matters may be produced due to sliding friction between the leaf-spring-shaped contactor 4 and the movable conductor 8. The foreign matters thus produced are made to stay in the grease pools 13 by the sliding elements 12 arranged in front and rear of the leaf-spring-shaped contactor 4. It is thus possible to prevent the foreign matters from scattering from the electrode to the external space. In an area between the sliding elements 12 provided on both sides of the leaf-spring-shaped contactor 4, the grease pools 13 inhibit the grease from running off of the sliding elements 12 because of the displacement of the grease caused by the sliding of the movable conductor 8.

The movable electrode 2 is provided with through-holes 15 which extend from the outer circumference of the electrode toward the grease pools 13. Preferably, two through-holes 15 are provided for each grease pool 13. At a time of overhaul, new grease is injected into one of the through-holes 15. The grease thus injected passes through the through-hole and pushes out old grease in the grease pool 13 from the other through-hole. Consequently, the grease between the movable conductor 8 and the contactor 4 can be replaced without disassembly of the switchgear.

Figure 7:
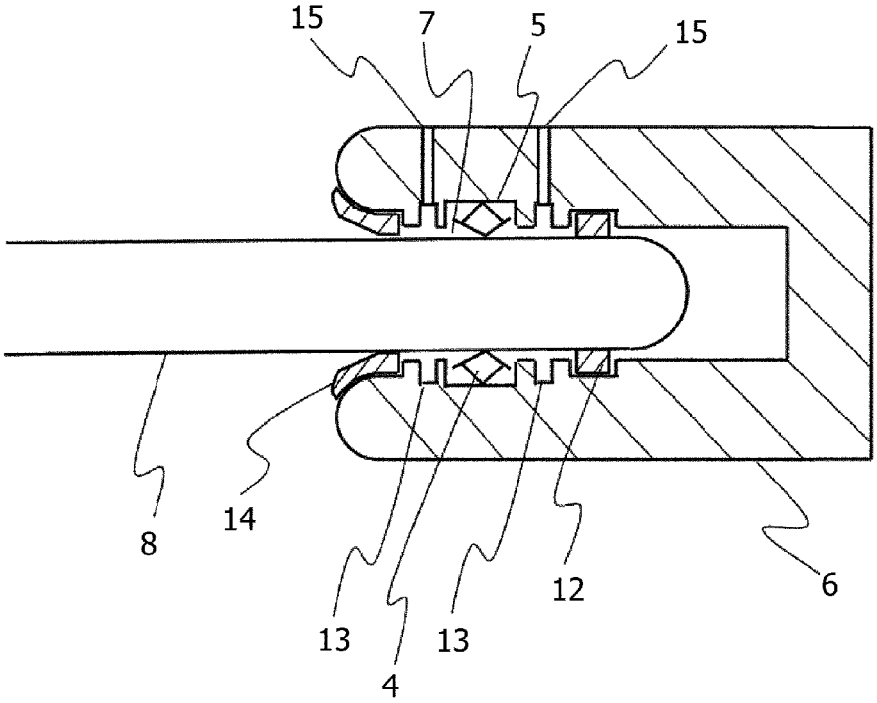
FIG. 7 is a cross-sectional view of a fixed electrode according to the second embodiment.

FIG. 7 is a cross-sectional view of the fixed electrode 6. A sliding element 14 is installed at an opening for inserting the movable conductor on the side of the fixed electrode 6. This sliding element 14 is formed into a shape tapered along the opening. Consequently, in the event that the movement of the movable conductor 8 deviates from a straight axis direction due to the link mechanism, the tapered sliding element 14 makes it possible to introduce the movable conductor 8 to a predetermined position with respect to the contactor 4 in the fixed electrode 6. The movable conductor 8 inserted into the fixed electrode 6 is such that the contact position between the leaf-spring-shaped contactor 4 and the movable conductor 8 can be brought in the allowable range of deformation amount of the contactor 4 during the contact therebetween by the sliding element 12 and the tapered sliding element 14 which are on both sides of the leaf-spring-shaped contactor 4 in the fixed electrode 6.

The height and inside, diameter of the sliding element 12 are set so that the contact position between the leaf-spring-shaped contactor 4 and the movable conductor 8 is in an allowable range of deformation amount, of the contactor 4 during the contact therebetween. Consequently, the sliding element. 12 constantly holds the movable conductor 8 for sliding at a position in the allowable range of deformation amount of the leaf-spring-shaped contactor 4. Thus, the movable conductor 12 can be brought into constant contact with the contactor 4, thereby providing a stable contact resistance value.

In the fixed electrode 6 a groove is provided as a grease pool 13 between a position at which the leaf-spring-shaped contactor 4 is disposed and another position at which the sliding element 12 is provided, and between the position at which the plate-like contactor 4 is disposed and a position at which the tapered sliding element 14 is provided. Foreign matters may be produced due to sliding friction between the leaf-spring-shaped contactor 4 and the movable conductor 8. The foreign matters thus produced can be prevented from scattering from, the electrode to the external space.

The grease pools 13 inhibit the grease from running off of the sliding element 12 and the tapered sliding element 14 because of the displacement of the grease caused by the sliding of the movable conductor 8 between the sliding element 12 and the tapered sliding element 14.

The fixed electrode 6 is provided with through-holes 15 which extend from the outer circumference of the electrode toward the grease pools 13. Preferably, two through-holes 15 are provided for each grease pool 13. At a time of overhaul, while the movable conductor 8 is inserted into the fixed electrode 6, new grease is injected from one of the through-holes 15. The grease thus injected passes through one of the through-holes 15 and pushes out old grease in the grease pool 13 from the other through-hole 15. Consequently, the grease between the movable conductor 8 and the contactor 4 can be replaced without the disassembly of the switchgear.

Figure 8:
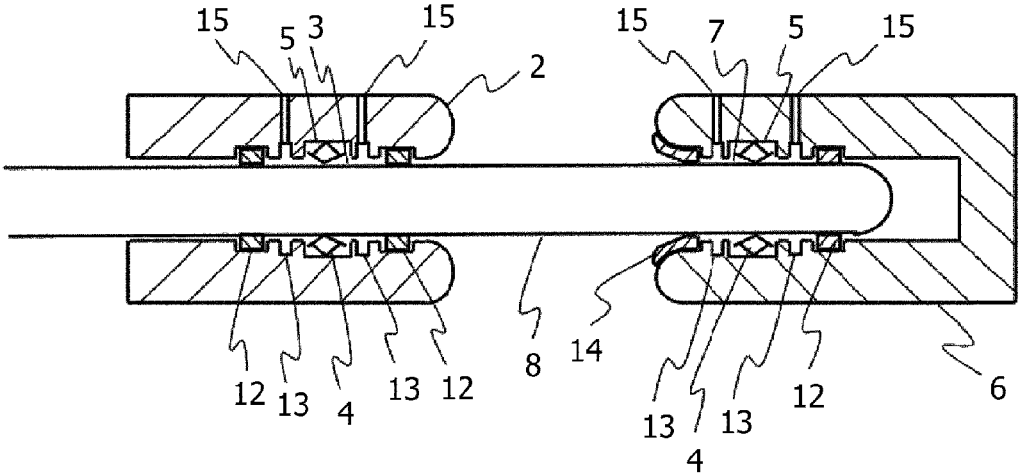
FIG. 8 illustrates the movable electrode and the fixed electrode according to the second embodiment being electrically connected.

The movable conductor 8 is inserted into the fixed electrode 6 to electrically connect the movable electrode 2 and the fixed electrode 6 as shown in FIG. 8. Although in such a condition, because of the configuration as above, the movable conductor 8 and the contactor 4 on the movable side, and the movable conductor 8 and the contactor 4 on the stator side slide in the allowable range of deformation amount of the contact. The partial contact between the movable conductor 8 and the contactor 4 is then eliminated in the sliding portion. As a result, the contact resistance between the movable conductor 8 and the contactor 4 can be reduced, in a stable manner.

The sliding elements 12 and the tapered sliding element 14 are arranged on both sides of the contactor 4; therefore, foreign matters produced due to the sliding between the movable conductor 8 and the contactor 4 can be prevented, from scattering to the external space of the electrode. Further, the through-holes 15 are provided which extend from the outer circumference of the electrode toward the grease pools 13. Thus, the grease can foe replaced without the disassembly of the switchgear at the time of overhaul.

What is claimed is:

1. A power switchgear comprising:

a fixed electrode and a movable electrode disposed opposite to each other in a tank filled with insulting gas; and a movable conductor electrically connecting the fixed electrode and the movable electrode together;

wherein the fixed electrode and the movable electrode each have a contactor through which current flows to the movable conductor;

wherein at least one of the fixed electrode and the movable electrode has ring-shaped sliding members, the ring-shaped sliding members being disposed on both sides of the contactor;

wherein at least one grease pool is provided between the contactor and the sliding members; and wherein the at least one grease pool is provided with at least two holes that radially pass through the fixed electrode or the movable electrode.

2. A power switchgear comprising:

a fixed electrode and a movable electrode disposed opposite to each other in a tank filled with insulting gas; and a movable conductor electrically connecting the fixed electrode and the movable electrode together;

wherein the fixed electrode and the movable electrode each have a contactor through which current flows to the movable conductor;

wherein the fixed electrode and the movable electrode each have ring-shaped sliding members on both sides of the contactor;

wherein one of the ring-shaped sliding members, provided to the fixed electrode and located close to the movable electrode, is arranged in a shape tapered along an opening of the fixed electrode, the opening facing the movable electrode;

wherein at least one groove provided as a grease pool is disposed between the contactor and the sliding members; and wherein the at least one grease pool is provided with at least two holes that radially pass through the fixed electrode or the movable electrode.

* * * * *